US008777383B2

(12) United States Patent
Izawa et al.

(10) Patent No.: US 8,777,383 B2
(45) Date of Patent: Jul. 15, 2014

(54) PRESSURE PURGING DEVICE FOR INKJET RECORDING APPARATUS

(75) Inventors: Hideo Izawa, Chiba (JP); Akira Ishikawa, Chiba (JP); Wataru Itabashi, Chiba (JP)

(73) Assignee: Miyakoshi Printing Machinery Co., Ltd., Narashino-shi, Chiba (JP)

( * ) Notice: Subject to any disclaimer, the term of this patent is extended or adjusted under 35 U.S.C. 154(b) by 24 days.

(21) Appl. No.: 13/134,897

(22) Filed: Jun. 20, 2011

(65) Prior Publication Data

US 2012/0001987 A1 Jan. 5, 2012

(30) Foreign Application Priority Data

Jun. 30, 2010 (JP) ..... 2010-150368

(51) Int. Cl.
*B41J 2/175* (2006.01)

(52) U.S. Cl.
USPC ..... 347/85; 347/92; 347/17; 438/30; 137/111

(58) Field of Classification Search
USPC ..... 347/84–87, 56–59
See application file for complete search history.

(56) References Cited

U.S. PATENT DOCUMENTS

| | | | | |
|---|---|---|---|---|
| 6,281,916 | B1 * | 8/2001 | VanSteenkiste et al. | 347/85 |
| 7,033,005 | B2 * | 4/2006 | Nakamura | 347/85 |
| 7,614,725 | B2 * | 11/2009 | Schulmeister | 347/57 |
| 7,824,023 | B2 * | 11/2010 | Izawa et al. | 347/85 |
| 8,297,744 | B2 * | 10/2012 | Hayashi et al. | 347/85 |
| 8,382,222 | B2 * | 2/2013 | Shinkai et al. | 347/7 |
| 2002/0015083 | A1 * | 2/2002 | Thorpe et al. | 347/85 |
| 2005/0045096 | A1 * | 3/2005 | Kojima et al. | 118/323 |
| 2005/0078144 | A1 | 4/2005 | Yamada et al. | |
| 2005/0168503 | A1 | 8/2005 | Mitsuzawa | |
| 2006/0187278 | A1 | 8/2006 | Langford et al. | |
| 2007/0139468 | A1 | 6/2007 | Schulmeister | |
| 2008/0238957 | A1 * | 10/2008 | Hayashi et al. | 347/7 |
| 2009/0046132 | A1 * | 2/2009 | Izawa et al. | 347/85 |
| 2010/0302324 | A1 | 12/2010 | Grossrubatscher | |

FOREIGN PATENT DOCUMENTS

| | | | |
|---|---|---|---|
| EP | 1 892 101 | A1 | 2/2008 |
| WO | WO 2008/138586 | A1 | 11/2008 |

OTHER PUBLICATIONS

European Patent Office Search Report dated Oct. 19, 2011 (5 pages).

* cited by examiner

*Primary Examiner* — Matthew Luu
*Assistant Examiner* — Lily Kemathe
(74) *Attorney, Agent, or Firm* — Flynn, Thiel, Boutell & Tanis, P.C.

(57) ABSTRACT

A pressure purging device for an inkjet recording apparatus includes a back pressure tank 21, a distribution tank 12, ink opening/closing electromagnetic valves 13, and recording heads 14, and in which the distribution tank 12 is connected to the back pressure tank 21 via an ink supply path 24, the ink opening/closing electromagnetic valves 13 are attached to the distribution tank 12 while being connected to the recording heads 14 via the distribution supply pipe 15, the ink opening/closing electromagnetic valves 13 are directly attached to the distribution tank 12, and there is provided an air switching three-port electromagnetic valve 61 connected to an upper part inside of the back pressure tank 21 via an air path 63 while being connected to a compressed air supply path 62.

1 Claim, 3 Drawing Sheets

PRESSURE PURGING DEVICE FOR INKJET RECORDING APPARATUS

TECHNICAL FIELD

The present invention relates to a pressure purging device for an inkjet recording apparatus.

BACKGROUND ART

Conventionally, in an inkjet recording apparatus, maintenance functions for preventing or recovering from a malfunction such as clogging of a nozzle of a recording head are indispensable.

Conventionally, as one of the maintenance functions, a pressure purge for extruding ink from a recording head and a suction purge for sucking out ink from the recording head have generally been known.

Conventionally, an inkjet recording apparatus including a plurality of nozzle heads (recording heads) and having a suction purging function for sucking out ink from the plurality of nozzle heads (recording heads) has been known (see Patent Document 1).

Conventionally, an inkjet recording apparatus having the following configuration having a pressure purging function for extruding ink from a large number of ink discharge channels has been known.

More specifically, in the inkjet recording apparatus, a large number of ink discharge channels are classified into a plurality of groups (head units), a plurality of manifolds for distributing ink from an ink supply source (an ink tank) among the ink discharge channels is provided for each of the groups (head units), and only a valve corresponding to the group (head unit) including the channel on which defective ink discharge occurs is opened, to pressurize and supply the ink with a pump.

Thus, bubbles and thickened ink are forced to be discharged, an amount of ink uselessly consumed to perform a recovery operation is reduced, the possibility that the ink discharge channel from which the ink is normally discharged is closed by the bubbles is reduced, and the recovery operation is efficiently performed in a short time (see Patent Document 2).

Conventionally, an inkjet recording apparatus having the following configuration (see FIG. 3) having a pressure purging function for extruding ink from a plurality of individual heads 151 has been known.

More specifically, during recording, the ink is self-supplied by being discharged out of the individual heads 151 from an intermediate tank 131 via a supply valve 133, a common flow path 134, a distributor 141, and an individual head supply path 145.

The ink is sent by a liquid sending pump 122 from an ink tank 111 via a replenishment flow path 121 when a bulge detection sensor 132 determines that replenishment is required, and is replenished by a predetermined amount to a replenishment valve 123 and the intermediate tank 131.

The distributor 141 provided halfway in the common flow path 134 is provided to make a flow path resistance of ink to be supplied to the individual heads 151 constituting a recording head 150 uniform and functions as a supply source for a short time.

When the recording head 150 is recovered, an atmosphere communication shutoff valve 143 disposed in an upper part of the distributor 141 is opened, to reverse the liquid sending pump 122, and slightly suck air in the distributor 141 serving as a part of an ink flow path, and is closed.

Then, the ink is sent by rotating the liquid sending pump 122 forward, and is extruded by a nozzle of the individual head 151 selected by an individual head valve 146 via a replenishment valve 125 and a pressure flow path 124 for bypassing the intermediate tank 131.

After dripping of the ink from the nozzle of the individual head 151 is stopped, a nozzle surface is wiped by a wiper blade 161 disposed in a maintenance stand 160.

An air vent flow path 171 having an air vent valve 144 is installed from the upper part of the distributor 141, and air is discharged from the flow path during initial introduction of the ink and when air is mixed into an ink supply path (see Patent Document 3).

PRIOR ART DOCUMENTS

Patent Documents

Patent Document 1 Japanese Patent Application Laid-Open Publication No. 2005-313384

Patent Document 2 Japanese Patent Application Laid-Open Publication No. 2002-225302

Patent Document 3 Japanese Patent Application Laid-Open Publication No. 2007-245615

SUMMARY OF THE INVENTION

Problems that the Invention Solves

However, in an inkjet recording apparatus discussed in the above-mentioned Patent Document 1 (Japanese Patent Application Laid-Open Publication No. 2005-313384), ink is supplied from a distribution tank, respectively, to nozzle heads (recording heads) via ink distribution tubes.

Each of the ink distribution tubes does not include an opening/closing valve (that is, the distribution tank and each of the nozzle heads (recording heads) are directly connected to each other by the ink distribution tube). Therefore, a purging operation cannot be performed in units of nozzle heads (recording heads).

In an inkjet recording apparatus discussed in the above-mentioned Patent Document 2 (Japanese Patent Application Laid-Open Publication No. 2002-225302), an opening/closing operation of each valve can perform a pressure purging operation in units of head units. However, ink is pressurized and sent using a pump during a pressure purging operation. Therefore, there is a problem that there occurs such an inconvenience that ink leaks out of a joint unit such as the valve due to a rapid pressure change of an ink tube by pulsation.

In an inkjet recording apparatus discussed in the above-mentioned Patent Document 3 (Japanese Patent Application Laid-Open Publication No. 2007-245615), a pressure purging operation can be performed in units of individual heads 151 by an opening/closing operation of each individual head valve 146. However, ink, together with air sucked in, is pressurized and sent by a sending liquid pump 122 during the pressure purging operation. Therefore, there is a problem that there occurs such an inconvenience that ink leaks out of a joint unit such as the individual head valve 146 due to a rapid pressure change of the individual head supply path 145 by pulsation.

The present invention has been made to solve the above-mentioned problems.

More specifically, the present invention is directed to providing a pressure purging apparatus for an inkjet recording apparatus capable of enabling pressure purging for only a designated one of a plurality of recording heads and preventing ink from leaking during pressure purging.

Means for Solving the Problems

The invention provides a pressure purging device for an inkjet recording apparatus including a back pressure tank, a distribution tank, a plurality of ink opening/closing electromagnetic valves, and a plurality of recording heads, and in which the distribution tank is connected to the back pressure tank via an ink supply path, the plurality of ink opening/closing electromagnetic valves is attached to the distribution tank while being connected to the plurality of recording heads via a distribution supply pipe, characterized in that the plurality of ink opening/closing electromagnetic valves is directly attached to the distribution tank.

The invention also is characterized in that there is provided an air switching three-port electromagnetic valve connected to an upper part inside of the back pressure tank via an air path while being connected to a compressed air supply path.

Advantage of the Invention

According to the invention, each of the ink opening/closing electromagnetic valves is directly attached to the distribution tank. Therefore, ink does not leak from the periphery of each of the ink opening/closing electromagnetic valves during pressure purging.

According to the invention, ink is pressurized by compressed air, only the ink opening/closing electromagnetic valve corresponding to the designated recording head is opened and pressure-purging is enabled for only the designated recording head.

BRIEF DESCRIPTION OF DRAWINGS

FIG. 2(A) is a front view, and FIG. 2(B) is a left side view.

BEST MODE FOR CARRYING OUT THE INVENTION

A pressure purging device for an inkjet recording apparatus according to an embodiment of the present invention will be described in detail below with reference to FIGS. 1, 2(A) and 2(B).

Figure 1:
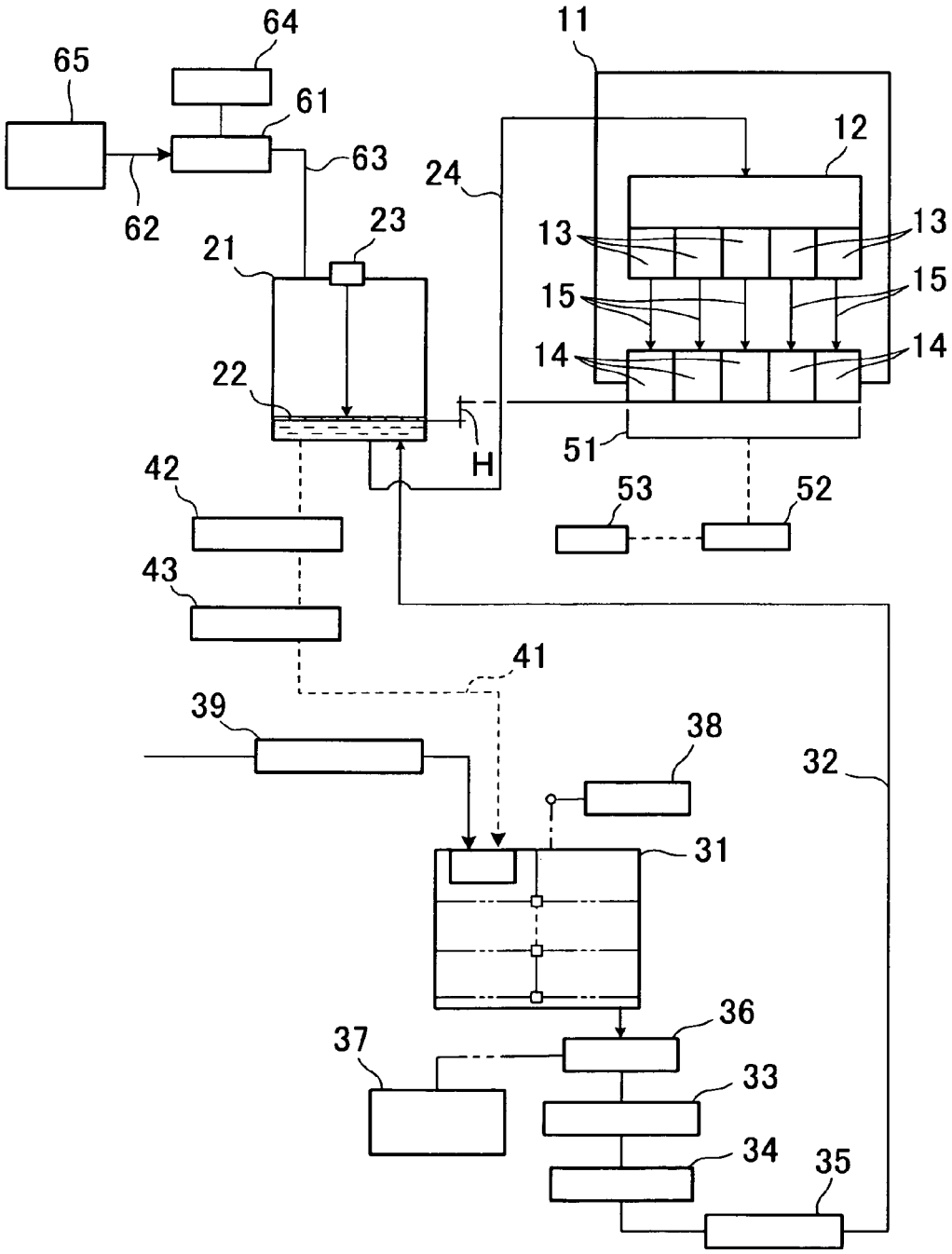
FIG. 1 is an illustration schematically illustrating an ink supply system in a pressure purging device for an inkjet recording apparatus according to an embodiment.

As illustrated in FIG. 1, a pressure purging device for an inkjet recording apparatus according to an embodiment of the present invention includes a head box 11, a back pressure tank 21, a main tank 31, an air switching three-port electromagnetic valve 61, a compressed air supply path 62, an air path 63, and a compressed air supply source 65 for supplying compressed air to the air switching three-port electromagnetic valve 61 via the compressed air supply path 62.

Figure 2:
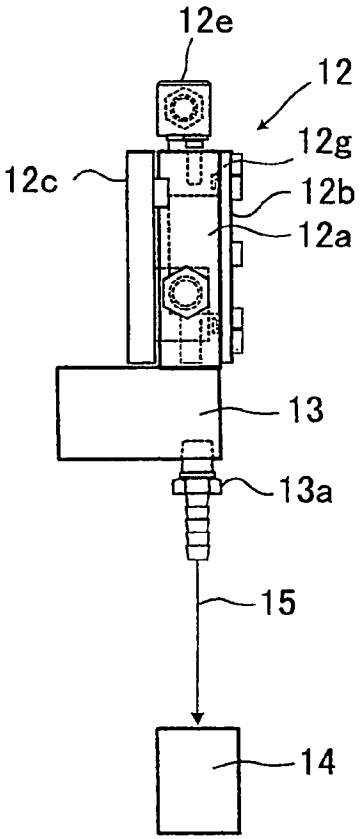
FIG. 2 illustrates a distribution tank, where
Figure 2:
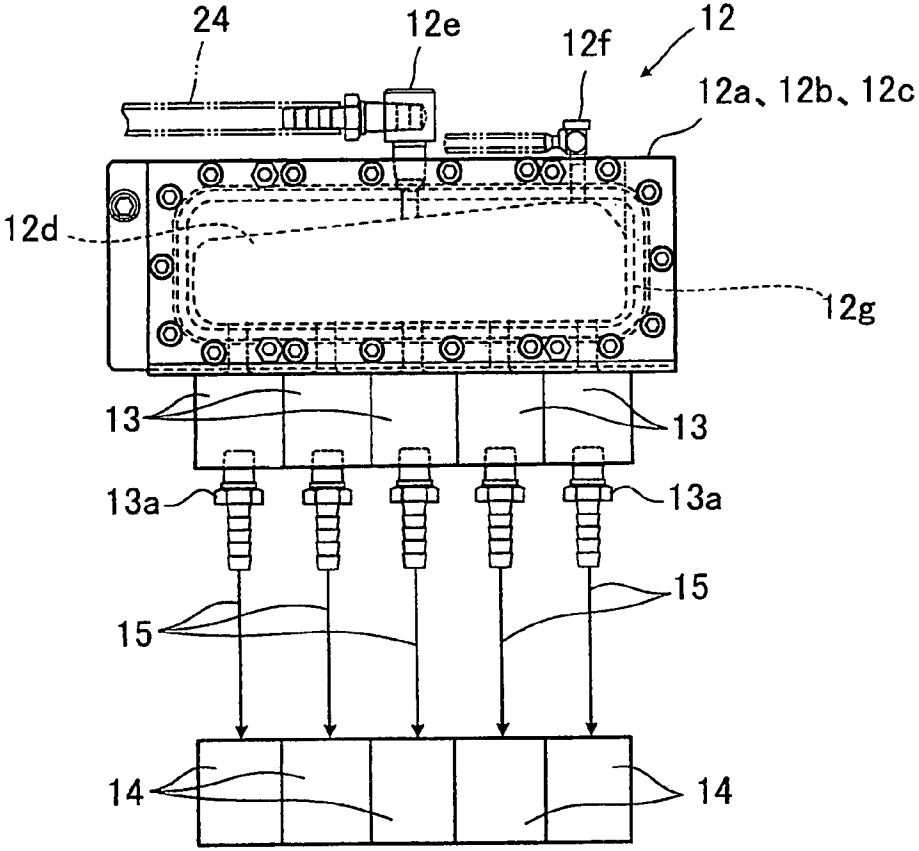
Figure 3:
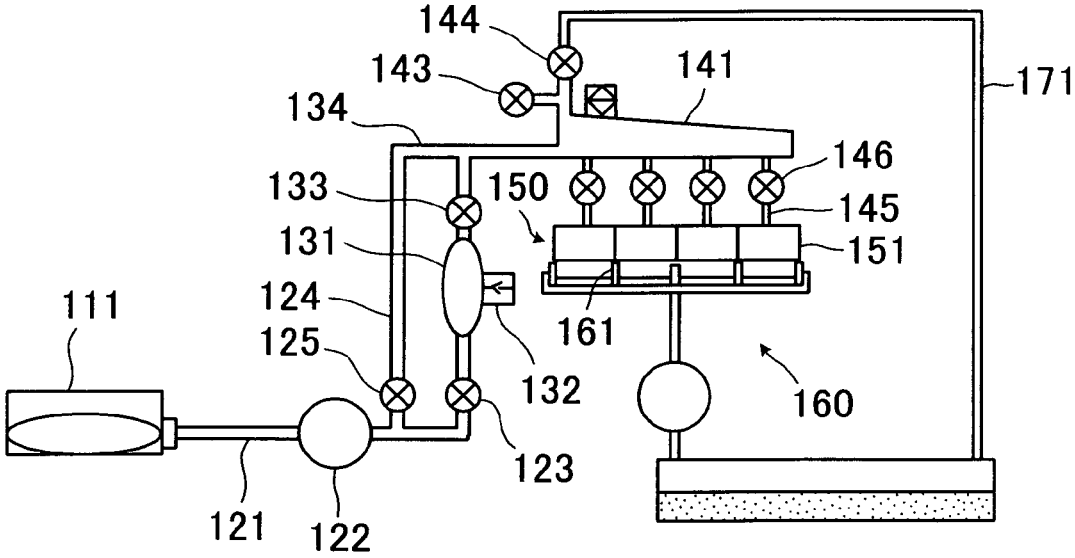
Fig.3 Prior Art
FIG. 3 is an illustration of an inkjet recording apparatus having a conventional pressure purging function.

A distribution tank 12, a plurality of (five) ink opening/closing electromagnetic valves 13 directly attached to the distribution tank 12, a plurality of (five) recording heads 14, and a plurality of (five) distribution supply pipes 15 are accommodated, as illustrated in FIG. 2(A) and FIG. 2(B), in the head box 11, and the distribution supply pipes 15 respectively connect the ink opening/closing electromagnetic valves 13 and the recording heads 14.

Distribution supply pipe insertion units 13*a* for inserting the distribution supply pipes 15 are respectively attached to the ink opening/closing electromagnetic valves 13.

An electromechanical converter such as a piezoelectric element is used for the inkjet recording apparatus. A control device (not illustrated) drives the electromechanical converter, such as the piezoelectric element, and an ink droplet is discharged from each of the recording heads 14 and recorded on a recorded member such as paper (not illustrated).

As illustrated in FIG. 2(A) and FIG. 2(B), a transparent cover 12*b* and a plate 12*c* are attached to the distribution tank 12 with a frame 12*a* and a packing 12*g* sandwiched therebetween, and a space 12*d* in the frame 12*a* is filled with ink.

One end of an ink supply path 24, described below, is connected to an ink supply path connection member 12*e* (see FIG. 2(A) and FIG. 2(B)) attached to the top of the frame 12*a* in the distribution tank 12.

An air vent member 12*f* for removing air in the frame 12*a* is connected to the top of the frame 12*a* in the distribution tank 12.

As illustrated in FIG. 1, the back pressure tank 21 contains a float 22 that floats in contact with a substantially whole surface of a liquid surface of ink stored therein.

The back pressure tank 21 is provided with a liquid surface detector 23 for detecting the height of the liquid surface of the ink via the float 22.

There is provided an ink supply path 24 for connecting the bottom of the back pressure tank 21 and the distribution tank 12.

The compressed air supply path 62 to which compressed air is supplied from the exterior, the air switching three-port electromagnetic valve 61 to which the compressed air supply path 62 is connected, and an air filter 64 connected to the air switching three-port electromagnetic valve 61 are arranged above the back pressure tank 21, and the air switching three-port electromagnetic valve 61 communicates with an upper part inside of the back pressure tank 21 via the air path 63.

The air switching three-port electromagnetic valve 61 is used by being switched between the time of recording by the recording head 14 and the time of pressure purging, as described below.

A main tank supply pump 39 supplies ink to the top of a main tank 31, and the top of the main tank 31 communicates with the atmosphere via an air filter 38.

The bottom of the back pressure tank 21 and the bottom of the main tank 31 are connected to each other via an ink replenishment path 32.

An ink replenishment pump 33 for replenishing ink from the main tank 31 according to a consumed amount of ink in the back pressure tank 21, an ink replenishment electromagnetic valve 34, a replenishment ink filter 35, and a deaeration module 36 are intermediated in the ink replenishment path 32 for connecting the back pressure tank 21 and the main tank 31.

A deaeration controller 37 is connected to the deaeration module 36.

An ink return path 41 connects the bottom of the back pressure tank 21 and the top of the main tank 31, and a back pressure tank return electromagnetic valve 42 and a back pressure tank return pump 43 are provided halfway in an ink return path 41.

A pan 51 is arranged at a position opposing the plurality of recording heads 14 and below the plurality of recording heads 14, and a waste tank 52 connected to the pan 51 and a waste collection unit 53 connected to the waste tank 52 are provided.

During recording, the air switching three-port electromagnetic valve 61 is switched to a position open to the atmosphere by an operation of a control device (not illustrated). Therefore, the back pressure tank 21 communicates with the atmosphere via the air filter 64 so that the supply of the compressed air is stopped.

The control device (not illustrated) controls operations of the ink replenishment pump 33 and the ink replenishment electromagnetic valve 34 using a detected value of the liquid surface detector 23.

More specifically, when ink in the back pressure tank 21 is supplied to the recording heads 14 via the ink supply path 24, the distribution tank 12, the ink opening/closing electromagnetic valves 13, and distribution supply pipes 15 so that a liquid surface of the ink in the back pressure tank 21 is reduced, the ink replenishment electromagnetic valve 34 is opened in response to a signal from the liquid surface detector 23 that has detected the reduction of the liquid surface at this time while the ink replenishment pump 33 is operated to replenish the ink to the back pressure tank 21 from the main tank 31.

When an amount of the replenished ink becomes a predetermined amount, and the liquid surface of the ink in the back pressure tank 21 becomes a predetermined position, the ink replenishment pump 33 is stopped in response to a signal from the liquid surface detector 23 for detecting the liquid surface of the ink while the ink replenishment electromagnetic valve 34 is closed so that the liquid surface of the ink in the back pressure tank 21 is always maintained at a predetermined height.

Therefore, a positional relationship in a height direction between the liquid surface of the ink in the back pressure tank 21 and a head surface of the recording head 14 is constant so that a predetermined position head H is kept.

A function during pressure purging will be described below.

During recording, the air switching three-port electromagnetic valve 61 that is switched so that the inside of the back pressure tank 21 is open to the atmosphere is switched by an operation of the control device (not illustrated) so that compressed air is supplied to an upper part inside of the back pressure tank 21 during pressure purging.

By this switching operation, the opening of the air switching three-port electromagnetic valve 61 to the atmosphere is interrupted.

Thus, the compressed air supplied to the upper part inside of the back pressure tank 21 causes the liquid surface of the ink in the back pressure tank 21 to be pressurized via the float 22.

The recording head 14 that is defective in discharge is designated by a switch in a control device (not illustrated) so that only the ink opening/closing electromagnetic valve 13 corresponding to the designated recording head 14 is opened.

Consequently, pressurized ink is supplied to only the designated recording head 14, bubbles and thickened ink are discharged to the pan 51 from a nozzle hole.

Waste ink discharged to the pan 51 is recovered in the waste liquid tank 52, and is collected in the waste collection unit 53.

The pressure purging device for the inkjet recording apparatus according to the embodiment of the present invention has the following effect.

Ink is pressurized by compressed air, only the ink opening/closing electromagnetic valve 13 corresponding to the designated recording head 14 is opened, and pressure purging is enabled for only the designated recording head 14.

The pressurization at this time is by compressed air. Therefore, there is no pulsation as in pressurization by a pump, and leakage of ink from a piping joint unit can be reduced.

Each of the ink opening/closing electromagnetic valves 13 is directly attached to the distribution tank 12. Therefore, there is no leakage of ink from the periphery of each of the ink opening/closing electromagnetic valves 13 during the pressure purging.

Although the present invention has been described above, the present invention is not limited to the embodiment. Various modifications are possible if the present invention suits its purpose.

For example, a compressed air supply path to which an air switching three-port electromagnetic valve is connected includes a common air tank installed in a factory, for example.

The air switching three-port electromagnetic valve is not necessarily of an electromagnetic type. An air switching three-port electromagnetic valve can be used if it can be switched.

It goes without saying that the present invention is also usable for an inkjet recording apparatus of a thermal inkjet type in addition to an inkjet recording apparatus of a piezoelectric inkjet type using an electromechanical converter such as a piezoelectric element.

INDUSTRIAL APPLICABILITY

The present invention is directed to providing a pressure purging device for an inkjet recording apparatus enabling pressure purging for only a designated one of a plurality of recording heads and capable of preventing ink from leaking during the pressure purging. However, the present invention can be widely used in various ways as an apparatus for performing recording using an inkjet method on a recording medium as long as its principle is applied.

DESCRIPTION OF REFERENCE NUMERALS

11 head box
12 distribution tank
12*a* frame
12*b* cover
12*c* plate
12*d* space
12*e* ink supply path connection member
12*f* air vent member
12*g* packing
13 ink opening/closing electromagnetic valve
13*a* distribution supply pipe insertion unit
14 recording head
15 distribution supply pipe
21 back pressure tank
22 float
23 liquid surface detector
24 ink supply path
31 main tank
32 ink replenishment path
33 ink replenishment pump
34 ink replenishment electromagnetic valve
35 replenishment ink filter
36 deaeration module
37 deaeration controller
38 air filter
39 main tank supply pump
41 main return path
42 back pressure tank return electromagnetic valve
43 back pressure tank return pump
51 pan
52 waste liquid tank
53 waste collection unit

61 air switching three-port electromagnetic valve
62 compressed air supply path
63 air path
64 air filter
65 compressed air supply source
H position head

The invention claimed is:

1. A pressure purging device for an inkjet recording apparatus comprising a back pressure tank, a distribution tank, a plurality of ink opening/closing electromagnetic valves, and a plurality of recording heads, and in which the distribution tank is connected to the back pressure tank via an ink supply path, the plurality of ink opening/closing electromagnetic valves are directly attached to the distribution tank while being connected to the plurality of recording heads via a distribution supply pipe, characterized in that a cover and a plate are attached to the distribution tank with a frame and a packing sandwiched therebetween, a space in the frame being filled with ink, an air vent member for removing air in a frame is connected to the top of a frame in the distribution tank, an air switching three-port electromagnetic valve is connected to an upper part inside of the back pressure tank via an air path, a compressed air supply path via which compressed air is supplied and an air filter communicating with the atmosphere, the back pressure tank contains a float that floats in contact with a substantially whole surface of a liquid surface of ink stored therein, the air switching three-port electromagnetic valve is switched so that the inside of the back pressure tank is open to the atmosphere during recording, and is switched so that compressed air is supplied to an upper part inside of the back pressure tank during pressure purging, and the compressed air causes the liquid surface of the ink in the back pressure tank to be pressurized via the float so that the ink thus pressurized is supplied to the designated recording head.

* * * * *